US006376434B1

(12) United States Patent
Katafuchi

(10) Patent No.: US 6,376,434 B1
(45) **Date of Patent: *Apr. 23, 2002**

(54) LUBE OIL COMPOSITIONS FOR DIESEL ENGINES

(75) Inventor: Tadashi Katafuchi, Ichihara (JP)

(73) Assignee: Idemitsu Kosan Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/956,394

(22) Filed: Oct. 23, 1997

(30) Foreign Application Priority Data

Oct. 29, 1996 (JP) ..... 8-286269

(51) Int. Cl.[7] ..... C10M 161/00; C10M 149/00

(52) U.S. Cl. ..... 508/291; 508/391; 508/460; 508/586

(58) Field of Search ..... 508/291, 391, 508/460, 586

(56) References Cited

U.S. PATENT DOCUMENTS

| | | | | |
|---|---|---|---|---|
| 3,172,892 A | * | 3/1965 | Le Suer et al. | |
| 3,272,746 A | * | 9/1966 | Le Suer et al. | |
| 4,495,075 A | * | 1/1985 | Buckley | 508/291 |
| 4,842,755 A | | 6/1989 | Adrian Dunn | |
| 4,981,603 A | * | 1/1991 | Demange | 508/291 |
| 5,370,805 A | | 12/1994 | Smrcka et al. | |
| 5,523,417 A | * | 6/1996 | Blackborow et al. | 508/291 |
| 5,644,001 A | * | 7/1997 | Blackborow et al. | 508/301 |
| 6,140,280 A | * | 10/2000 | Nakano et al. | 508/291 |

FOREIGN PATENT DOCUMENTS

| | | | |
|---|---|---|---|
| EP | 0 008 193 | | 2/1980 |
| EP | 0 331 359 | | 9/1989 |
| EP | 0 689 689 | | 12/1995 |
| EP | 0 765 929 | | 4/1997 |
| GB | 1162172 | | 8/1969 |
| JP | 6-271885 | * | 3/1993 |

OTHER PUBLICATIONS

Organic Chemistry, 3rd Ed., Morrison et al, Allyn & Bacon, Inc., Boston, 1976, pp. 410–412 and 776–778.*

* cited by examiner

*Primary Examiner*—Margaret Medley
(74) *Attorney, Agent, or Firm*—Oblon, Spivak, McClelland, Maier & Neustadt, P.C.

(57) ABSTRACT

A lube oil composition which is suitably used for diesel engines which exhaust large amounts of sulfur dioxides ($So_x$). The composition exhibit excellent corrosion/wear preventive properties against $SO_x$. The lube oil composition of the invention for diesel engines includes a lube oil base having a kinematic viscosity of 8–35 $mm^2/s$ at 100° C.; a component (A) which is a compound selected from the group consisting of over based sulfonates of alkaline earth metals, over based phenates of alkaline earth metals, and over based salicylates of alkaline earth metals; and a component (B) which is a bis-type succinic imide compound having an absorption ratio, $\alpha/\beta$ (wherein $\alpha$ is the intensity of an absorption peak at 1550±10 $cm^{-1}$ and $\beta$ is the intensity of an absorption peak at 1700±10 $cm^{-1}$), of absorption peaks in an IR spectrum of not more than 0.005.

7 Claims, No Drawings

LUBE OIL COMPOSITIONS FOR DIESEL ENGINES

BACKGROUND OF THE INVENTION

1. Field of the Invention

The present invention relates to lube oil compositions for diesel engines, and more particularly to lube oil compositions suitable for use as cylinder oils for two-cycle marine engines.

2. Description of the Related Art

Fuels used for diesel engines generally have high sulfur content, and therefore, exhaust gases from diesel engines contain large amounts of sulfur oxides (hereinafter collectively referred to as $SO_x$). $SO_x$ reacts with moisture which is also present in exhaust gases to form sulfuric acid, which breaks an oil film of a lube oil for diesel engines and corrodes or wears components of the diesel engine. Particularly in the case of two-cycle marine engines, corrosion and wear of cylinder liners or piston rings raise serious problems. Therefore, lube oils for diesel marine engines must have properties that can effectively prevent corrosion and wear. To this end, conventional lube oils for diesel engines (hereinafter maybe referred to as diesel engine oils) have been designed to include metallic detergents/dispersants of the over based type, to thereby neutralize sulfuric acid that has been produced.

With a recent trend of increased popularity of diesel engines for land vehicles which are equipped with a unique system of circulating and recombusting exhaust gas (EGR, i.e., exhaust gas recirculation) for coping with exhaust gases, the $SO_x$ content of exhaust gases tends to increase. Also, in diesel marine engines, fuels of high sulfur content are widely used with an aim of cutting costs. However, this invites a tendency of increased $SO_x$ content as is the case with diesel engines for land vehicles.

As a conceivable measure for solving this problem, the amount of a over based metallic detergent/dispersant, which serves as a neutralizer, may be increased. However, the sole use of this approach cannot sufficiently neutralize and remove large amounts of sulfuric acid, and therefore, corrosion and wear cannot be fully prevented.

There has been tried another approach in which metallic detergents/dispersants are used in combination with a plurality of additives such as ashless dispersants to thereby promote the neutralizing effect of the metallic detergents/dispersants for acids, so as to prevent wear and corrosion of cylinder liners and piston rings. For example, Japanese Patent Application Laid-Open (kokai) No. 6-271885 discloses in its Example section additives containing Ca-salicylate and bis-type alkenylsuccinic imide. However, in order to promote the effect of neutralizing acid by use of the bis-type alkenylsuccinic imide, an amine molybdenum complex must be further added.

In this connection, the ability of diesel engine oils to prevent wear/corrosion of cylinder liners or piston rings can be assessed by measurement of the reaction rate of the lube oil to neutralize acids, because acid neutralization reaction rate is known to correlate with corrosion/wear of cylinder liners and piston rings.

The present invention has been made in view of the foregoing, and the object of the present invention is to provide a lube oil composition for diesel engines, which is endowed with excellent anticorrosion/antiwear properties even when used for diesel engines which exhaust large amounts of $SO_x$.

SUMMARY OF THE INVENTION

The present inventors have conducted careful studies based on the aforementioned acid neutralization rate, and have found that when a specific type of over based alkaline earth metal compound is combined with a specific type of succinic imide compound, the object of the present invention can be effectively attained, leading to completion of the present invention.

Accordingly, the present invention is directed to a lube oil composition for diesel engines, which comprises a lube oil base having a kinematic viscosity of 8–35 $mm^2/s$ at 100° C.; a component (A) which is at least one compound selected from the group consisting of over based sulfonates of alkaline earth metals, over based phenates of alkaline earth metals, and salicylates of over based alkaline earth metals; and a component (B) which is a bis-type succinic imide compound having an absorption ratio, $\alpha/\beta$, of absorption peaks in an IR spectrum (wherein $\alpha$ is the intensity of an absorption peak at 1550±10 $cm^{-1}$ and $\beta$ is the intensity of an absorption peak at 1700±10 $cm^{-1}$) of not more than 0.005.

The present invention also relates to a lube oil composition for diesel engines, which comprises component (A) in an amount of 5–40% by weight and component (B) in an amount of 0.1–3% by weight, both based on the total weight of the composition.

The present invention also relates to a lube oil composition for diesel engines, in which the total base number of the composition falls within the range from 30 to 150 mgKOH/g.

The present invention still further relates to a lube oil composition for diesel engines, wherein the concentration of the nitrogen atoms contained in the composition is 10–200 ppm by weight based on the total weight of the composition.

These and other objects, features, and advantages of the present invention will become apparent from the following description.

MODES FOR CARRYING OUT THE INVENTION

The present invention will next be described in detail.

The lube oil base of the lube oil composition of the present invention for diesel engines is a mineral oil and/or a synthetic oil having a kinematic viscosity of 8–35 $mm^2/s$, preferably 10–25$mm^2/s$. If the kinematic viscosity at 100° C. is higher than 35 $mm^2/s$, the fuel consumption rate becomes unsatisfactory, whereas if it is less than 8, the lube oil composition evaporates considerably, both cases being not preferable. There is no particular limitation as to the pour point—which serves as an index for the low temperature fluidity—of the base oil. However, it is generally preferred that the pour point be not higher than −10° C.

Several types of mineral oils and synthetic oils are usable in the present invention, and they are suitably selected in accordance with use, etc. Examples of mineral oils include, but are not limited to, paraffin base mineral oils, naphthene-type mineral oils, and intermediate-base-type mineral oils. Specific examples of mineral oils include light neutral oils, intermediate neutral oils, heavy neutral oils, and bright stocks.

Examples of synthetic oils include, but are not limited to, poly$\alpha$-olefin, $\alpha$-olefin copolymers, polybutene, alkylbenzene, polyol esters, dibasic acid esters, polyoxyalkylene glycols, polyoxyalkylene glycol esters, and polyoxyalkylene glycol ethers.

These base oils may be used singly or in combination of two or more species, and a mineral oil and a synthetic oil may be used in combination.

Components (A) and (B) which are incorporated into the lube oil base will next be described.

Component (A)

The component (A) of the present invention is a compound selected from the group consisting of over based sulfonates, phenates, and salicylates of alkaline earth metals. These compounds have conventionally been used as metallic detergents/dispersants. Preferable total base numbers of these compounds fall within the range from 100 to 600 mgKOH/g (JIS K-2501: perchloricacid method). Total base numbers of lower than 100 mgKOH/g require increased amounts of additives, and therefore are economically disadvantageous. On the other hand, if the total base number is in excess of 600 mgKOH/g, the ash content of the lube oil increases, raising the risk of producing great amounts of deposit during long-term use.

The over based sulfonates of alkaline earth metals that are usable as component (A) may usually be obtained through carbonation of alkaline earth metal salts of a variety of sulfonic acids. Examples of usable sulfonic acids include aromatic petrosulfonic acids, alkylsulfonic acids, arylsulfonic acids, and alkyl sulfonic acids. Specific examples of preferred over based sulfonates of alkaline earth metals include dodecylbenzenesulfonic acid, dilaurylcetylbenzenesulfonic acid, paraffin-wax-substituted benzenesulfonic acid, polyolefin-substituted benzenesulfonic acid, polyisobutylene-substituted benzenesulfonic acid, and naphthalenesulfonic acid.

More preferable over based sulfonates of alkaline earth metals include compounds of the following formulas (1) and (2):

(1)

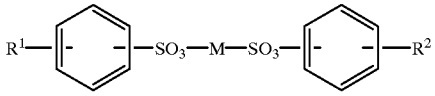

wherein each of $R^1$ and $R^2$, which may be identical to or different from each other, represents an alkyl group, preferably a C20–C30 alkyl group, and M represents an alkaline earth metal, which is preferably calcium, magnesium, or barium:

(2)

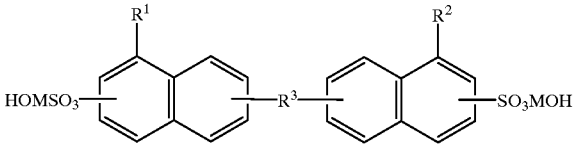

wherein $R^1$, $R^2{}_1$ and M have the same meanings as defined in formula (1), and $R^3$ represents an alkylene group, preferably a C10–C40 alkylene group, more preferably a C20–C30 alkylene group.

The over based phenates—another type of compounds (A)—of alkaline earth metals are alkaline earth metal salts of an alkyl phenol or a sulfidized alkyl phenol. They are usually obtained through carbonation of alkaline earth metal salts of an alkyl phenol or a sulfidized alkyl phenol.

Examples of preferred over based phenates of alkaline earth metals include compounds of the following formulas (3) and (4):

(3)

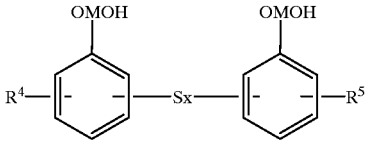

wherein each of $R^4$ and $R^5$, which may be identical to or different from each other, represents an alkyl group, preferably a C1–C20 alkyl group, more preferably a C5–C8 alkyl group, M represents an alkaline earth metal, preferably calcium, magnesium, or barium, and x is a positive number from 1 to 2;

(4)

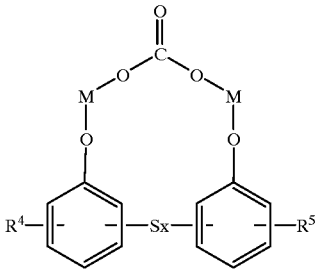

wherein $R^4$, $R^5$, M, and x have the same meanings as defined in formula (3).

The over based salicylates—still another type of compounds (A)—of alkaline earth metals are alkaline earth metal salts of an alkyl salicylate. They are usually obtained by alkylating a phenol with C8–C18 α-olefin, carrying out a Kolbe-Schmitt reaction to thereby introduce a carboxyl group, then a double decomposition, to complete carbonation.

More specifically, compounds of the following formula (5) may be used as the over based salicylates of a alkaline earth metal.

(5)

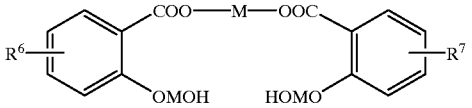

wherein each of $R^6$ and $R^7$, which may be identical to or different from each other, represents an alkyl group, preferably a C10–C40 alkyl group, more preferably a C20–C30 alkyl group, M represents an alkaline earth metal, preferably calcium, magnesium, or barium, and x is a positive number from 1 to 2.

Specific examples of alkyl salicylates include dodecyl salicylate, dodecylmethyl salicylate, tetradecyl salicylate, hexadecyl salicylate, octadecyl salicylate, and dioctadecyl salicylate.

Alkaline earth metals for preparing sulfonates, phenates, and salicylates include calcium, magnesium, and barium. From the viewpoint of effect, calcium is preferred.

In the present invention, compound (A) may be used singly or in combination. It is preferably incorporated in an amount of 5–40% by weight, more preferably 10–30% by weight with respect to the total weight of the composition. Amounts less than 5% by weight may sometimes result in an insufficient acid neutralization effect, whereas amounts in excess of 40% by weight no longer produce appreciable effects commensurate with the amounts used.

Component(B)

Examples of ashless dispersants of the bis-type succinic imide include alkenylsuccinic imides and alkylsuccinic imides. These two bis-type succinic imides have a ratio $\alpha/\beta$ of absorption peaks in an IR spectrum (wherein $\alpha$ is the intensity of an absorption peak at $1550\pm10\ cm^{-1}$ and $\beta$ is the intensity of an absorption peak at $1700\pm10\ cm^{-1}$) of not more than 0.005, preferably not more than 0.003. When the ratio $\alpha/\beta$ is in excess of 0.005, acid cannot be neutralized sufficiently.

As used herein, the intensity of an absorption peak refers to the height of the peak after the background has been subtracted.

Alkenylsuccinic imides are generally represented by the following formula (6):

(6)

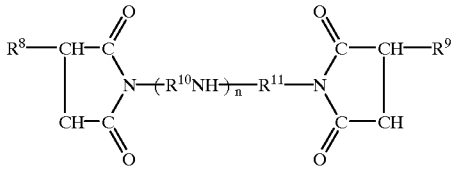

wherein each of $R^8$ and $R^9$, which may be identical to or different from each other, represents an alkenyl group having an average molecular weight of 200–4,000, preferably 500–3,000, more preferably 700–2,300, which are prepared from C2–C15 olefin polymers; each of $R^{10}$ and $R^{11}$, which may be identical to or different from each other, represents a C2–C5 alkenyl group, and n is an integer between 1 and 10 inclusive. The alkenyl groups $R^8$ and $R^9$ are preferably polyisobutenyl.

The bis-type alkenylsuccinic imides may be obtained by reacting polyisobutene or an ethylene-propylene copolymer with maleic anhydride, and then with polyamine. Examples of polyamines include monoalkylenediamines such as ethylenediamine, propylenediamine, butylenediamine, and pentylenediamine; and polyalkylene polyamines such as diethylenetriamine, triethylenetetramine, tetraethylenepentamine, pentaethylene-hexamine, dibutylenetriamine, tributylenetetramine, and pentapentylenehexamine.

The bis-type imide alkyl succinates may be obtained by hydrogenation at the alkenyl groups $R^8$ and $R^9$ in formula (6) before or after the reaction with the aforementioned polyamine.

In the present invention, component (B) may be used singly or in combination. Component (B) is generally incorporated in an amount of 0.1–3% by weight, preferably 0.2–2% by weight, with respect to the total weight of the composition. Amounts less than 0.1% by weight may sometimes result in an insufficient acid neutralization effect obtainable from the synergism with component (A), whereas amounts in excess of 3% by weight may no longer produce appreciable effects commensurate with the amounts used.

The total base number of the composition of the present invention is preferably adjusted to fall within the range from 30 to 150 mgKOH/g, preferably 40 to 100 mgKOH/g (JIS K-2501; perchloric base method). Total acid numbers of less than 30 mgKOH/g may fail to neutralize acids perfectly, whereas total base numbers of higher than 150 mgKOH/g may increase the ash content in lube oil, raising the risk of producing great amounts of deposit during long-term use.

The concentration of all the nitrogen atoms of the composition of the present invention is preferably adjusted to fall within the range from 10 to 200 ppm, preferably from 20 to 100 ppm, on a weight basis. Total nitrogen atom concentrations of less than 10 ppm by weight may result in insufficient acid neutralization, whereas concentrations higher than 200 ppm by weight may easily form sludge during the process of degradation due to oxidation that may occur after prolonged use of the lube oil.

The composition of the present invention may be obtained by mixing the above-described components (A) and (B) with a lube oil base. Generally, in order to improve properties of a lube oil, additives such as antioxidants, viscosity index improvers, metal deactivating agents, pour point depressants, antiwear agents, antifoaming agents, and extreme pressure agents may also be incorporated. There is no particular limitation as to the additives that may be used, and a wide variety of conventionally employed additives may be used. Examples of antioxidants include, but are not limited to, amines such as alkylated diphenylamines, and phenyl-$\alpha$-naphthylamines; and phenol compounds such as 2,6-di-t-butyl phenol and 4,4'-methylenebis-(2,6-di-t-butyl phenol). These are used in amounts of 0.05–2% by weight with respect to the weight of the entirety of the composition. Examples of viscosity index improvers include, but are not limited to, polymethyl methacrylate, polyisobutylene, ethylene-propylene copolymers, styrene-isoprene copolymers, and styrene-butadiene hydrogenated copolymers. These are generally incorporated in amounts of 0.5–30% by weight with respect to the weight of the entirety of the composition. Examples of metal deactivating agents include benzotriazole, thiadiazole, and alkenylsuccinates. These are generally incorporated in amounts of 0.005–1% by weight with respect to the weight of the entirety of the composition. Examples of pour point depressants include polyalkyl methacrylate and polyalkylstyrene. These are generally used in amounts of 0.01–1% by weight with respect to the weight of the entirety of the composition. Examples of antiwear agents include organic molybdenum compounds such as MoDTP and MoDTC; organic zinc compounds such as ZnDTP, and organic boron compounds such as alkyl mercaptylborate, and solid lubricant-type antiwear agents such as graphite, molybdenum disulfide, antimony sulfide, boron compounds, and polytetrafluoroethylene. These are generally used in amounts of 0.1–3% by weight with respect to the weight of the entirety of the composition. Examples of antifoaming agents include dimethylpolysiloxane and polyacrylate, which are generally used in amounts of 0.0005–1% by weight with respect to the weight of the entirety of the composition. Examples of extreme pressure agents include sulfides of oils and fats, and diallyl disulfides. They are generally used in amounts of 0.1–15% by weight with respect to the weight of the entirety of the composition.

EXAMPLES

The present invention will next be described by way of examples, which should not be construed as limiting the present invention.

Examples 1 and 2, and Comparative Examples 1 through 3

The ingredients shown in Table 1 were mixed in amounts indicated in the Table, to thereby prepare lube oil compositions for a diesel engine which were representatives of the present invention (Examples 1 and 2) and compositions for comparison (Comparative Examples 1 through 3). All the compositions prepared were adjusted to have a total base number of 71.4 mgKOH/g. The compositions were assessed in terms of acid neutralization reaction rate and also subjected to stability tests in a manner described below. The results are shown in Table 1.

(1) Method of Performing Assessment of the Acid Neutralization Reaction Rate

Each of the inventive and comparative compositions was used as a sample oil. Each oil composition (100 g) was placed in a 1-liter, round-bottomed, glass-autoclave, and when the temperature of the sample oil reached 200° C., 35.9N sulfuric acid (1 ml) was added thereto and the contents were stirred. As shown in the reaction scheme (1) below, carbon dioxide gas was generated from the acid neutralization reaction:

$$CaCO_3+H_2SO_4 \rightarrow CaSO_4+H_2O+CO_2\uparrow \quad (1)$$

The acid neutralization reaction rate was assessed from the variation in pressure due to the generated carbon dioxide gas (pressure rise in the reaction system 30 seconds after addition of sulfuric acid). The greater the rise in pressure, the more corrosion/wear are considered to be suppressed.

(2) Stability Test

The lube oil compositions for diesel engines (inventive products and comparative products) were left to stand for one month, and clarity of the compositions was checked.

○: Clear

X: Cloudy a component (B) which is a bis succinic imide of the formula:

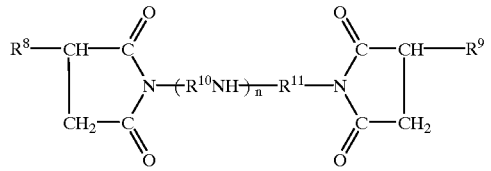

wherein each of $R^8$ and $R^9$, which may be identical or different from each other, represents an alkenyl group having an average molecular weight of 200–4,000 which are prepared from $C_2$–$C_{15}$ olefin polymers;

each of $R^{10}$ and $R^{11}$, which may be identical to or different from each other, represents a $C_2$–$C_5$ alkenyl group, and n is an integer between 1 and 10 inclusive, and having an absorption ratio, $\alpha/\beta$, of an absorption peak in an IR spectrum of not more than 0.005, wherein $\alpha$ is the intensity of an absorption peak at 1550±10 $cm^{-1}$ and $\beta$ is the intensity of an absorption peak at 1700±10 $cm^{-1}$, wherein the concentration of nitrogen atoms contained in the composition is 20–200 ppm, component (A) is present in an amount of 10–30% by weight and component (B) is present in an amount of 0.1–3% by weight, each based on the total weight of the composition, and wherein the total base number of the composition is from 30 to 150 mg KOH/g.

TABLE 1

| | | Example 1 | Example 2 | Comparative Example 1 | Comparative Example 2 | Comparative Example 3 |
|---|---|---|---|---|---|---|
| Composition (wt. %) | Base oil *1 | 85.5 | 78.2 | 85.5 | 85.5 | 78.2 |
| | Ca-sulfonate *2 | 14 | 7 | 14 | 14 | 7 |
| | Ca-phenate *3 | — | 14.3 | — | — | 14.3 |
| | Bis-type alkenylsuccinic imide *4 | 0.5 | 0.5 | 0.5 | — | 0.5 |
| | Mono-type alkenylsuccinic imide *5 | — | — | — | 0.5 | — |
| $\alpha/\beta$ | | 0.004 | 0.004 | 0.007 | — | 0.008 |
| Concentration of total nitrogen atoms (ppm by weight) | | 50 | 50 | 55 | 105 | 50 |
| Pressure rise in the system after 30 sec. ($kgf/cm^2$) | | 2.2 | 1.6 | 0.4 | 0 | 0.3 |
| Stability test | | ○ | ○ | ○ | X | ○ |

*1: Mineral oil, kinematic viscosity: 20 $mm^2/s$ (100° C.)

*2: Total base number: 510 mgKOH/g (JIS K-2501: Perchloric acid method)

*3: Total base number: 250 mgKOH/g (JIS K-2501: Perchloric acid method)

*4: Number-average molecular weight of polyisobutenyl groups: 1000, Nitrogen content: 0.95 wt. %

*5: Number-average molecular weight of polyisobutenyl groups: 1000, Nitrogen content: 2.02 wt. %

As described hereinabove, the lube oil compositions of the present invention for diesel engines, having very rapid acid neutralization rate, exhibit excellent corrosion/wear prevention effect against $SO_x$ which is exhausted in considerable amounts, and therefore are suitably used as cylinder oils for two-cycle marine engines.

What is claimed is:

1. A method for protecting 2-cycle diesel marine engines from corrosion and wear which comprises bringing components of said engine into contact with an effective amount of a lube oil composition which consist essentially of a lube oil base having a kinematic viscosity of 8–35 $mm^2/s$ at 100° C.;

a component (A) which is at least one compound selected from the group consisting of over based sulfonates of alkaline earth metals, over based phenates of alkaline earth metals, and over based salicylates of alkaline earth metals; and

2. The method of claim 1, wherein the total base number of the composition is from 40 to 150 mg KOH/g.

3. The method of claim 1, wherein the absorption ratio is not more than 0.003.

4. The method of claim 1, wherein component (B) is present in an amount of 0.2–2% by weight based on the total weight of the composition.

5. The method of claim 2, wherein component (B) is present in an amount of 0.2–2% by weight based on the total weight of the composition.

6. The method of claim 1, wherein $R^8$ and $R^9$ are polyisobutenyl.

7. The method of claim 2, wherein $R^8$ and $R^9$ are polyisobutenyl.

* * * * *